US008739367B2

(12) United States Patent
Park

(10) Patent No.: US 8,739,367 B2
(45) Date of Patent: Jun. 3, 2014

(54) HIDDEN DOOR HINGE

(76) Inventor: Jang-Ho Park, Daegu (KR)

( * ) Notice: Subject to any disclaimer, the term of this patent is extended or adjusted under 35 U.S.C. 154(b) by 0 days.

(21) Appl. No.: 13/636,675

(22) PCT Filed: Mar. 22, 2011

(86) PCT No.: PCT/KR2011/001939

§ 371 (c)(1),
(2), (4) Date: Sep. 22, 2012

(87) PCT Pub. No.: WO2011/118951

PCT Pub. Date: Sep. 29, 2011

(65) Prior Publication Data

US 2013/0014345 A1 Jan. 17, 2013

(30) Foreign Application Priority Data

Mar. 22, 2010 (KR) ..... 10-2010-0025084

(51) Int. Cl.

| | |
|---|---|
| ***E05D 7/04*** | (2006.01) |
| ***E05D 7/00*** | (2006.01) |
| ***E05D 11/00*** | (2006.01) |
| ***E05D 11/10*** | (2006.01) |

(52) U.S. Cl.
USPC ..... 16/389; 16/245; 16/240; 16/271

(58) Field of Classification Search
USPC ..... 16/389, 390, 236, 237, 238, 240, 243, 16/245, 246, 248, 368, 369, 271, 272
See application file for complete search history.

(56) References Cited

U.S. PATENT DOCUMENTS

| | | | | | |
|---|---|---|---|---|---|
| 920,445 | A | * | 5/1909 | Essig | 16/245 |
| 932,601 | A | * | 8/1909 | Corbett | 16/268 |
| 1,037,807 | A | * | 9/1912 | Thurber | 16/245 |
| 1,092,236 | A | * | 4/1914 | Wrikeman | 16/271 |
| 1,186,637 | A | * | 6/1916 | Williams | 16/272 |
| 1,290,230 | A | * | 1/1919 | Kenniker | 16/267 |
| 1,469,525 | A | * | 10/1923 | Nadolney | 16/271 |
| 2,211,581 | A | * | 8/1940 | Ross | 16/364 |
| 3,300,809 | A | * | 1/1967 | Neerman et al. | 16/270 |
| 3,439,377 | A | * | 4/1969 | Bucholz | 16/389 |
| 3,965,532 | A | * | 6/1976 | Wigfall | 16/270 |
| RE30,717 | E | * | 8/1981 | Dargene | 16/264 |

(Continued)

FOREIGN PATENT DOCUMENTS

| | | | |
|---|---|---|---|
| DE | 2454923 | A * | 8/1976 |
| JP | 03137381 | A * | 6/1991 |

(Continued)

OTHER PUBLICATIONS

RD 336025 A, Apr. 1992.*

*Primary Examiner* — Victor Batson
*Assistant Examiner* — Jason W San
(74) *Attorney, Agent, or Firm* — Revolution IP, PLLC

(57) ABSTRACT

In accordance with the disclosure, in various door constructions, a projection of a door leaf is inserted in a hollow of a doorframe, height of the door leaf is minutely adjusted, and an interval between the door leaf and the doorframe is adjusted, which results in easy fastening of the door leaf and the doorframe and reduced construction time. In addition, the door leaf is completely fastened to the doorframe through the locking mechanism, the door leaf is prevented from being twisted in long use, thereby increasing its durability.

8 Claims, 5 Drawing Sheets

(56) References Cited

U.S. PATENT DOCUMENTS

| | | | | | |
|---|---|---|---|---|---|
| 4,357,736 | A * | 11/1982 | Karpisek | 16/263 |
| 4,407,044 | A * | 10/1983 | Iseki | 16/237 |
| 4,785,498 | A * | 11/1988 | Brotschi | 16/238 |
| 4,807,331 | A * | 2/1989 | Calucci | 16/262 |
| 4,873,745 | A * | 10/1989 | Ramsauer | 16/258 |
| 5,063,638 | A * | 11/1991 | Howard et al. | 16/238 |
| 5,071,185 | A * | 12/1991 | Schiele | 296/3 |
| 5,361,455 | A * | 11/1994 | Kiefer | 16/235 |
| 5,561,886 | A * | 10/1996 | Flamme | 16/265 |
| 5,920,958 | A * | 7/1999 | Domenig et al. | 16/237 |
| 5,930,866 | A * | 8/1999 | Rupprechter | 16/242 |
| 5,937,480 | A * | 8/1999 | Kiefer | 16/260 |
| 6,030,064 | A * | 2/2000 | Kim | 312/405 |
| 6,049,946 | A * | 4/2000 | Cress et al. | 16/240 |
| 6,516,494 | B2 * | 2/2003 | Nakamoto et al. | 16/271 |
| 6,766,561 | B1 * | 7/2004 | Cheng | 16/235 |
| 6,779,233 | B2 * | 8/2004 | Migli | 16/246 |
| 6,845,544 | B2 * | 1/2005 | Hofer | 16/246 |
| 6,901,633 | B2 * | 6/2005 | Chen | 16/240 |
| 6,918,158 | B2 * | 7/2005 | Isele | 16/235 |
| 7,010,832 | B2 * | 3/2006 | Chen | 16/252 |
| 7,231,691 | B1 * | 6/2007 | Domenig et al. | 16/236 |
| 7,331,085 | B2 * | 2/2008 | Heid | 16/242 |
| 7,334,293 | B2 * | 2/2008 | Erickson et al. | 16/243 |
| 7,346,959 | B2 * | 3/2008 | Heid | 16/242 |
| 7,480,962 | B2 * | 1/2009 | Takamatsu et al. | 16/382 |
| 7,520,023 | B2 * | 4/2009 | Hirtsiefer | 16/287 |
| 7,584,523 | B1 * | 9/2009 | Finkelstein et al. | 16/260 |
| 7,698,783 | B2 * | 4/2010 | Heid | 16/242 |
| 8,276,241 | B2 * | 10/2012 | Wu et al. | 16/238 |
| 8,381,355 | B2 * | 2/2013 | Pacini | 16/240 |
| 2004/0034969 | A1 * | 2/2004 | Wegman | 16/389 |
| 2004/0231104 | A1 * | 11/2004 | Kingelhofer | 16/342 |
| 2005/0005398 | A1 * | 1/2005 | Hirtsiefer | 16/346 |
| 2005/0183238 | A1 * | 8/2005 | McCue et al. | 16/236 |
| 2006/0137139 | A1 * | 6/2006 | Wu | 16/236 |
| 2007/0289094 | A1 * | 12/2007 | Lowe et al. | 16/238 |
| 2008/0271291 | A1 * | 11/2008 | Chen et al. | 16/238 |
| 2008/0307606 | A1 * | 12/2008 | Karlsson | 16/243 |
| 2010/0242227 | A1 * | 9/2010 | Tagtow et al. | 16/237 |
| 2013/0014345 | A1 * | 1/2013 | Park | 16/248 |
| 2013/0042435 | A1 * | 2/2013 | Schott | 16/321 |

FOREIGN PATENT DOCUMENTS

| | | | | |
|---|---|---|---|---|
| JP | 08028130 | A | * | 1/1996 |
| JP | 08500865 | A | | 1/1996 |
| JP | 08504910 | A | | 5/1996 |
| JP | 2000192748 | A | * | 7/2000 |
| JP | 2002129822 | A | * | 5/2002 |
| JP | 2004528500 | A | | 9/2004 |
| JP | 2004324059 | A | * | 11/2004 |
| JP | 2005507472 | A | | 3/2005 |
| JP | 2007211577 | A | * | 8/2007 |
| JP | 2008025269 | A | * | 2/2008 |
| JP | 2008303589 | A | * | 12/2008 |
| NL | 9000588 | A | * | 10/1991 |
| WO | WO 9511362 | A | | 4/1995 |
| WO | WO 03038218 | A1 | * | 5/2003 |

* cited by examiner

HIDDEN DOOR HINGE

TECHNICAL FIELD

The present invention relates to a hidden door hinge which connects a door, such as a fire door, to a doorframe, with an external appearance of the door hinge hidden from the outside with the door closed, and more particularly, to a hidden door hinge which facilitates vertical and horizontal adjustment of a door in construction and replacement of the door on demand.

BACKGROUND ART

A hidden hinge is structured to prevent its external appearance from being exposed to the outside when a door is closed. Such a hidden hinge is favorable to crime prevention since the door cannot be separated from a doorframe with the door closed and is in wide use for a fire door, an entrance door, a furniture door or the like since it does not spoil the beauty of the door.

In particular, since the hidden hinge cannot be broken up once being built, unlike an existing pivot hinge or butterfly hinge which can be broken up by a simple tool, it has a high advantage in the aspect of safety for crime prevention.

FIG. 1 shows a representative example of a conventional hidden hinge which has been in wide use for a fire door, including, as main components, a fixing piece 1, an axial pin 2 and a rotating piece 3. The fixing piece 1 has flanges 1*a* and 1*b* which are of a '⊓'-like clamp and are vertically formed in vertical linear ends. The axial pin 2 serves as a rotating supporting axis and is vertically disposed at one side of the fixing piece 1. The rotating piece 3 has a '⊔'-bent structure and can be freely rotated within a predetermined range of angle under a state where it is assembled into the fixing piece 1 by the axial pin 2 by providing a connecting piece 3*b* of the axial pin 15, in which the axial pin 15 is inserted, in one bent surface 3*a* of the rotating piece 3 to be assembled with the fixing piece 1.

On the other hand, screw holes 1*c* and 1*d* are formed in flanges 1*a* and 1*b* of the fixing piece 1, respectively, and the fixing piece 1 is fastened, by a screw 5, to a fixing piece fastener 4 for fixing the fixing piece 1 to a doorframe. In addition, several screw holes 3*d* are formed in the other bent surface 3*c* of the rotating piece 3 and a door leaf connecting fastener 6 for connecting the door (for example, a fire door) to the rotating piece 3 is fastened, by screws 7, to the screw holes 3*d*. Reference numeral 8 denotes an auxiliary fastener of the door leaf connecting fastener 6 which is welded with the door and is coupled to the door leaf connecting fastener 6 by a screw 9.

FIG. 2 shows an application of the above-configured hidden hinge to a fire door. Referring to FIG. 2, a structure where the hidden hinge is installed in a door leaf D and a doorframe F constituting the fire door is as follows. That is, a hinge installation part having a square hole through which a front of the hidden hinge is exposed is provided in a corresponding portion of the doorframe F in which the hidden hinge is installed, and the fixing piece 1 of the hidden hinge is fixed to the hinge installation part.

However, since the fixing piece fastener 4 is welded to the inner side of the doorframe F, with the fixing piece 1 arranged in the hinge installation part of the doorframe F, after the fixing piece fastener 4 is fastened to the flanges 1*a* and 1*b* of the fixing piece 1 by the screw 5, there is a problem of difficulty in later replacement of the fixing piece 1.

In other words, the door leaf connecting fastener 6 is coupled to the auxiliary fastener 8 and the auxiliary fastener 8 is welded to the door leaf D, and subsequently, the door leaf D is combined to the doorframe F when the door leaf connecting fastener 6 is fastened to the rotating piece 3 by the screws 7.

In construction of using the conventional hidden hinge to install the door leaf D in the doorframe F in this manner, the door leaf connecting fastener 6 has to be fastened to the rotating piece 3 of the hidden hinge installed in the hinge installation part of the doorframe F, with the door leaf connecting fastener 6 coordinated with the screw holes, under a state where the heavy door leaf D is lifted by a required height. This requires high work precision and long working time and makes the hidden hinge difficult to be fixed to a desired position due to weight of the door, which may result in poor construction ability. In addition, the screws 7 have to be unscrewed one by one when the door leaf D needs to be separated from the doorframe F or needs to be adjusted and the door may be drooped due to weight of the door, which may result in poor workability.

In addition, when the door leaf D is installed in the doorframe F with the conventional hidden hinge, the vertical height and horizontal interval of the door leaf D have to be adjusted precisely so that the door leaf D can fit into the doorframe F. However, it is very difficult to adjust the height of the door leaf D with respect to the doorframe F under the state where the door leaf connecting fastener 6 to be assembled in the rotating piece 3 of the hidden hinge and the auxiliary fastener 8 are installed in the door leaf D, which may result in great difficulty in construction. Moreover, since the fixing fastener 4 is welded to the doorframe F after the fixing piece 1 of the hinge is previously inserted in a punching back surface of the doorframe in construction of the doorframe, there arises a problem of difficulty in replacement of the hinge in the event of later failure or aging of the hinge.

DISCLOSURE OF INVENTION

Technical Problem

To overcome the above problems, it is an object of the present invention to provide a hidden door hinge which is capable of adjusting the height of a door leaf minutely and adjusting a gap between the door leaf and a doorframe, thereby allowing very easy connection of the door leaf and the doorframe, reduction in construction time and later simple replacement of the hinge.

Technical Solution

To achieve the above and other objects, according to a first aspect, the present invention provides a hidden door hinge including: a fixing piece (10) which forms a '⊔'-like bent structure and is fixed to a hinge installation part of a doorframe; a rotating piece (20) which has one side having an axial pin connecting piece coupled to an axial pin (15) serving as a rotating support axis and the other side which is connected to a door leaf and is inserted in the '⊔'-like bent structure of the fixing piece (10) when the door leaf is opened/closed; and a '⊔'-like door leaf connecting fastener (30) which is fixed to the door leaf and is inserted in and connected to the rotating piece (20), wherein the rotating piece (20) has a hollow (24) serving as an opening formed in one vertical side, a projection (35) of the door leaf connecting fastener (30) is inserted in and connected to the hollow (24), and the height of the projection (35) is adjusted by a first adjustor located in a vertical direction of the rotating piece (20) when the projection (35) is inserted in the hollow (24), such that the height of the door leaf is adjusted in door construction.

Preferably, the rotating piece (20) includes a first bent portion, which is a short portion in which the axial pin (15) is located, and a second bent portion, which is a long portion in which the hollow is formed, and the first adjustor has a first screw hole which is formed in a vertical side of the second bent portion of the rotating piece (20) and are connected to the hollow, the first adjustor being constituted by first bolts fastened to the first screw hole.

Preferably, the connecting fastener is constituted by a connector joined with the door leaf, and the projection which vertically extends from one side of the connector, and grooves with which the first bolts (26*a* and 26*b*) make contact are formed in the vertical side of the projection. Preferably, the hidden door hinge further includes a second adjustor 128 which is located in the opposite side to the opening of the second bent portion and adjusts horizontal movement of the door leaf by adjusting horizontal movement of the projection, and the second adjustor 128 includes: a first hollow hole connected to the hollow in a portion of the opposite side to the opening of the second bent portion; and a second bolt connected to a screw groove formed in the vertical side of the projection through the first hollow hole for adjustment of the horizontal movement of the door leaf.

Preferably, the first bolts may be wrench-typed polygonal bolts having a wide base, an end of the fixing piece has a flange shape and an edge diagonally opposing the axial pin is beveled, a through hole in which the axial pin is inserted is vertically formed in an end of the first bent portion, and the hinge further includes a locking mechanism 125 including a second hollow hole which is connected to the hollow in the center of the outer side of the second bent portion, and a third bolt which is inserted in the second hollow hole for performing a locking function to fix the projection.

Advantageous Effects

According to the present invention, in various door constructions, a projection of a door leaf can be easily inserted in a hollow of a doorframe, height of the door leaf can be minutely adjusted, and an interval between the door leaf and the doorframe can be easily adjusted, which can result in easy fastening of the door leaf and the doorframe and reduced construction time.

In addition, since the door leaf can be completely fastened to the doorframe through the locking mechanism, the door leaf can be prevented from being twisted in long use, thereby increasing its durability and the hinge can be simply and conveniently replaced with a new one as necessary.

BEST MODE FOR CARRYING OUT THE INVENTION

Hereinafter, preferred embodiments of the present invention will be described in detail with reference to the accompanying drawings.

Figure 3:
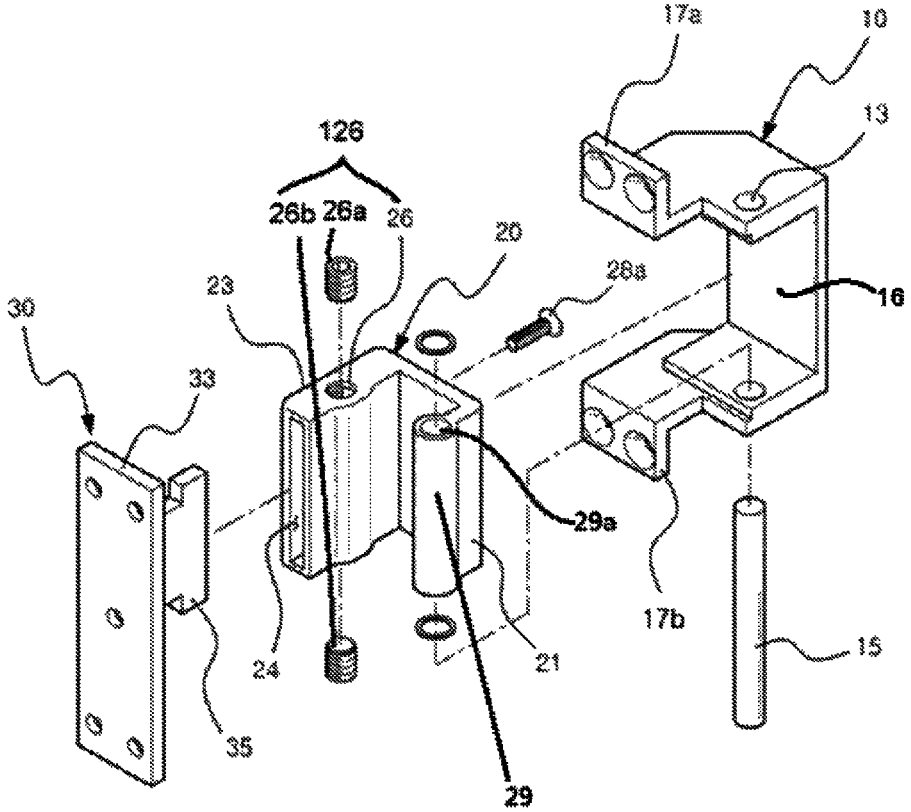
FIG. 3 is an exploded perspective view showing a hidden hinge according to an embodiment of the present invention.

FIG. 3 is an exploded perspective view showing a hidden hinge according to an embodiment of the present invention. Referring to FIG. 3, a hidden hinge includes a fixing piece 10 which forms a 'C'-like bent structure 16 and is fixed to a hinge installation part of a doorframe, a rotating piece 20 which has one side having an axial pin connecting piece 29 coupled to an axial pin 15 serving as a rotating support axis and the other side which is connected to a door leaf and is inserted in the 'C'-like bent structure 16 of the fixing piece 10 when the door leaf is opened/closed, and a 'L'-like door leaf connecting fastener 30 which is fixed to the door leaf and is inserted in and connected to the rotating piece 20, wherein the rotating piece 20 has a hollow 24 serving as an opening formed in one vertical side, a projection 35 of the door leaf connecting fastener 30 is inserted in and connected to the hollow 24, and the height of the projection 35 is adjusted by a first adjustor 126 located in a vertical direction of the rotating piece 20 when the projection 35 is inserted in the hollow 24, such that the height of the door leaf is adjusted in door construction.

In this manner, the hidden hinge of this embodiment includes the fixing piece 10, the axial pin 15, the rotating piece 20 and the door leaf connecting fastener 30. The fixing piece 10 is a member fixed to the hinge installation part of the doorframe and forms a 'C'-like bent structure 16. Flanges 17*a* and 17*b* fastened to the doorframe by screws are vertically bent at a leading end of a vertical bent surface of the bent structure. The axial pin 15 is a rotating support axis of the hinge and is installed at one side of a vertical bent surface of the fixing piece 10 in the vertical direction through a hole 13. The rotating piece 20 is rotatably supported to the fixing piece 10 by the axial pin 15 and is configured to be inserted in the 'C'-like bent structure 16 of the fixing piece 10 when the door is opened/closed.

Here, the rotating piece 20 includes a first bent portion 21 and a second bent portion 23, which are bent at right angle in parallel, showing the overall 'C' shape, and a through hole 29*a* in which the axial pin 15 is inserted is vertically formed in the end of the first bent portion 21.

In addition, the hollow 24 is formed at a predetermined depth inside the second bent portion 23 corresponding to a long side of the rotating piece 20, a first screw hole 26 connected to the hollow 24 is formed in a portion of the vertical side of the second bent portion 23, and first bolts 26*a* and 26*b* is fastened to the door leaf through the first screw hole 26 to adjust the height of the door leaf. This corresponds to a first adjustor 126 to adjust the height of the door leaf in construction.

The first bolts 26*a* and 26*b* may preferably be wrench-typed polygonal bolts having a wide base. Since the first bolts 26*a* and 26*b* function to push up the projection 35 of the connecting fastener 30 fixed to the door leaf. In addition, the wide base of the polygonal bolts may preferably be provided to receive a force of the bolts. The use of the polygonal bolts allows reduction in abrasion of heads of the bolts and high durability of the bolts.

In addition, a second adjustor 128 to adjust the horizontal movement of the door leaf is formed in the opposite side to the opening of the hollow 24 of the second bent portion and has a structure where a first hollow hole 28 connected to the hollow 24 is formed and joined with a second bolt 28*a*. That is, the second adjustor 128 has a structure to allow the horizontal movement of the door leaf by contacting and pushing or pulling the projection 35 of the connecting fastener 30 inserted in the hollow 24 by rotation of the second bolt 28*a*. In addition, the horizontal movement and fixation of the door leaf may be adjusted by fastening of the second bolt 28*a* joined with a second screw hole 38 formed in a side of a head of the projection 355 inserted in the hollow 24.

The connecting fastener 30 of the hidden hinge of this embodiment has a '⊔'-like structure and is constituted by a connector 33 joined with the door leaf, and the projection 35 which is bent to be connected to the rotating piece 20. Here, the connector 33 has a square plate shape and includes a through hole forming a plurality of screw combinations and the projection 35 vertically extends in a side of the connector.

The projection 35 has a structure inserted in and connected to the hollow 24 of the fixing piece 10 and may have various shapes. In this embodiment, as shown in FIG. 3, the projection 35 has a structure where grooves 37 are formed in its both sides. When the projection 35 is inserted in the hollow 24 of the rotating piece 20, the first bolts 26*a* and 26*b* joined to the vertical side of the rotating piece 20 can be inserted in and fixed to the grooves 37. In this manner, the projection 35 of the connecting fastener 30 has a structure to prevent the connecting fastener 30, which is connected to the door leaf after the projection 35 is adjusted in its vertical position by the first bolts 26*a* and 26*b*, from being rotated or moved, thereby allowing stable door leaf construction.

Thus, the adjustment structure in the joint of the door leaf and the rotating piece 20 facilitates adjustment of horizontal and vertical distance and height in construction of connecting the door leaf to the doorframe via the hinge and allows easy horizontal joining of the door leaf, which is different from the conventional hinge in terms of reduced construction time, precise door construction and easy later replacement.

Mode for Carrying Out the Invention

Figure 4:
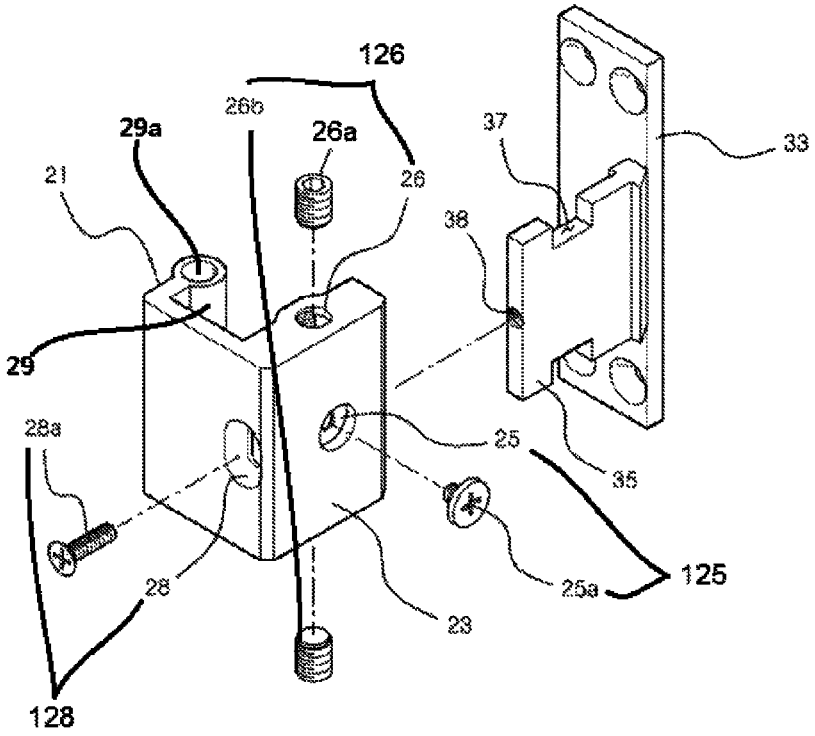
FIG. 4 is an exploded perspective view showing a connection of a rotating piece 20 and a connecting fastener 30 of the hidden hinge according to another embodiment of the present invention.

FIG. 4 is an exploded perspective view showing a connection of the rotating piece 20 and the connecting fastener 30 of the hidden hinge according to another embodiment of the present invention. Referring to FIG. 4, the connecting fastener 30 is fixed to at least two sides of the door leaf by screws. The joining portion of the connecting fastener 30 has more than four through holes through which the connecting fastener 30 is fastened to the door leaf by screws.

The projection 3 vertically extending from one side of the joining portion of the connecting fastener 30 is inserted in and connected to the hollow 24 of the rotating piece 20 and the vertical side of the projection 35 has grooves 37 through which the projection 35 is fixed by the first bolts 26*a* and 26*b* when the projection 35 is inserted in the hollow 24 of the rotating piece 20. In addition, a second screw hole 38 is formed in the center in the vertical surface of a head of the projection 35 inserted in the hollow 24 of the rotating piece 20, and the corresponding first hollow hole 28 is formed in the opposite side to the opening of the hollow 24 of the rotating piece 20, so that the projection 35 is combined by screw to the second screw hole 38 of the vertical side of the projection 35 by the second bolt 28*a* when the projection 35 is inserted in the hollow 24 of the rotating piece 20.

The fine horizontal movement of the connecting fastener 30 connected to the door leaf through such screw combination of the vertical side of the projection 35 can be achieved. That is, the horizontal gap between the door leaf and the rotating piece 20 can be adjusted by the second bolt 28*a* located in the vertical side so that a gap between the door leaf and the doorframe can be easily adjusted in door construction.

Unlike the embodiment shown in FIG. 3, in the embodiment shown in FIG. 4, a second hollow hole 25 connected to the hollow 24 of the rotating piece 20 is formed in the center of the outer side of the second bent portion 23, and, if the projection 35 of the connecting fastener 30 is inserted in and fixed to the hollow 24 of the rotating piece 20, the embodiments of FIG. 4 provide a locking mechanism 125 to prevent a constructed door leaf from being drooped and twisted in long use when the projection 35 is tightened by a third bolt 25*a* or the like in the second hollow hole 25. Here, the locking mechanism is preferably installed in the outer side of the second bent portion, although it may be optionally installed in the inner side of the second bent portion.

Figure 5:
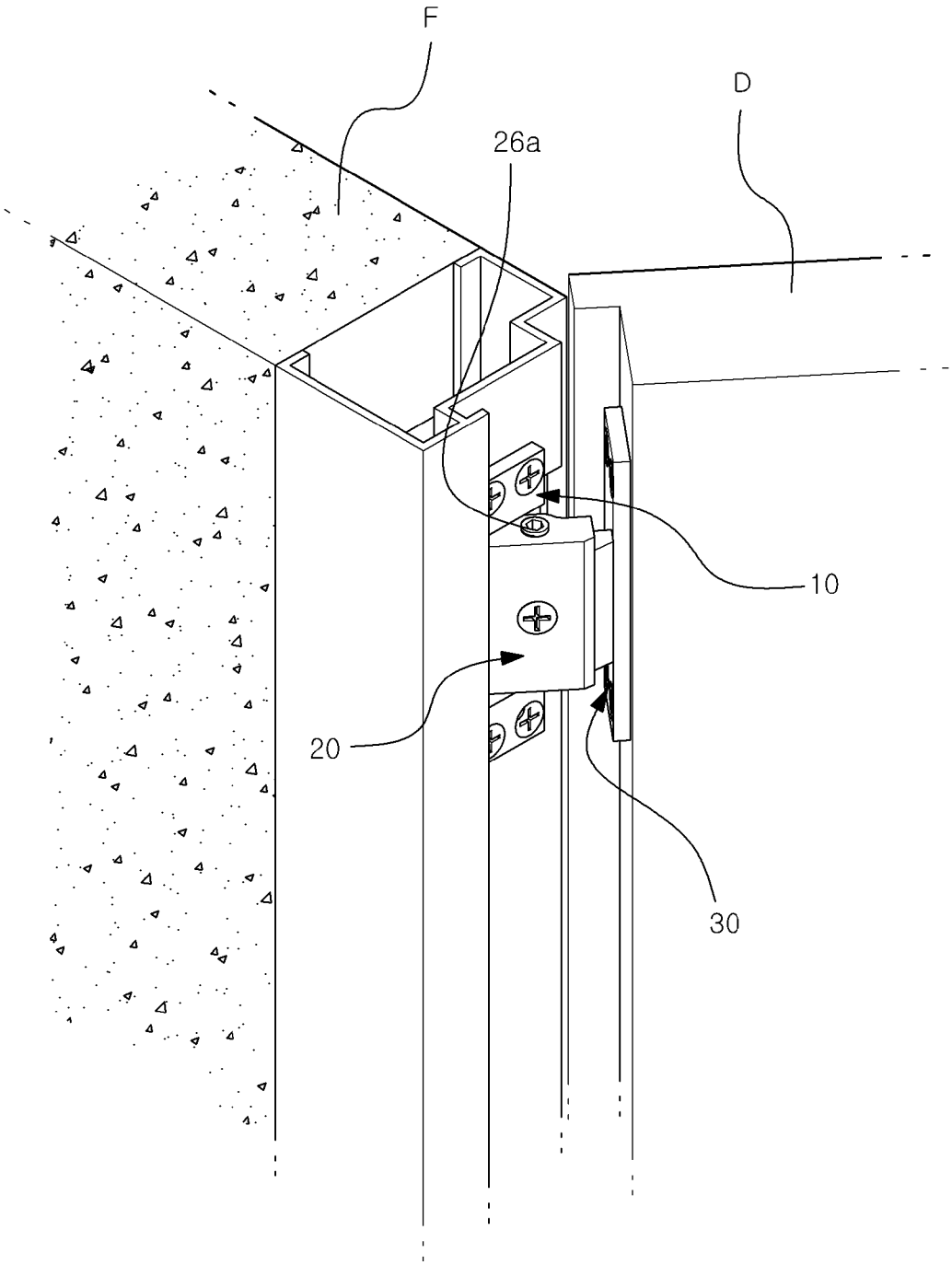
FIG. 5 is a view illustrating a structure of door construction where the hidden hinge is fastened to a door leaf and a doorframe.

FIG. 5 is a view illustrating a structure of door construction where the hidden hinge is fastened to the door leaf and the doorframe. As shown in FIG. 5, the connecting fastener 30 is combined and fixed to the door leaf, the fixing piece 10 is inserted in and fixed to a groove formed in the inner side of the doorframe, the rotating piece 20 is rotatably supported by the fixing piece 10 and the axial pin 15, and the projection 35 of the connecting fastener 30 is inserted in and fastened to the hollow 24 of the rotating piece.

In this manner, the hidden hinge of this embodiment has a structure where it is not externally revealed due to the groove formed in the inner side of the doorframe and is inserted in and fixed to the door leaf through easy adjustment of horizontal movement and height of the door leaf, which is advantageous over a conventional construction of screw combination of a fastener.

Figure 1:
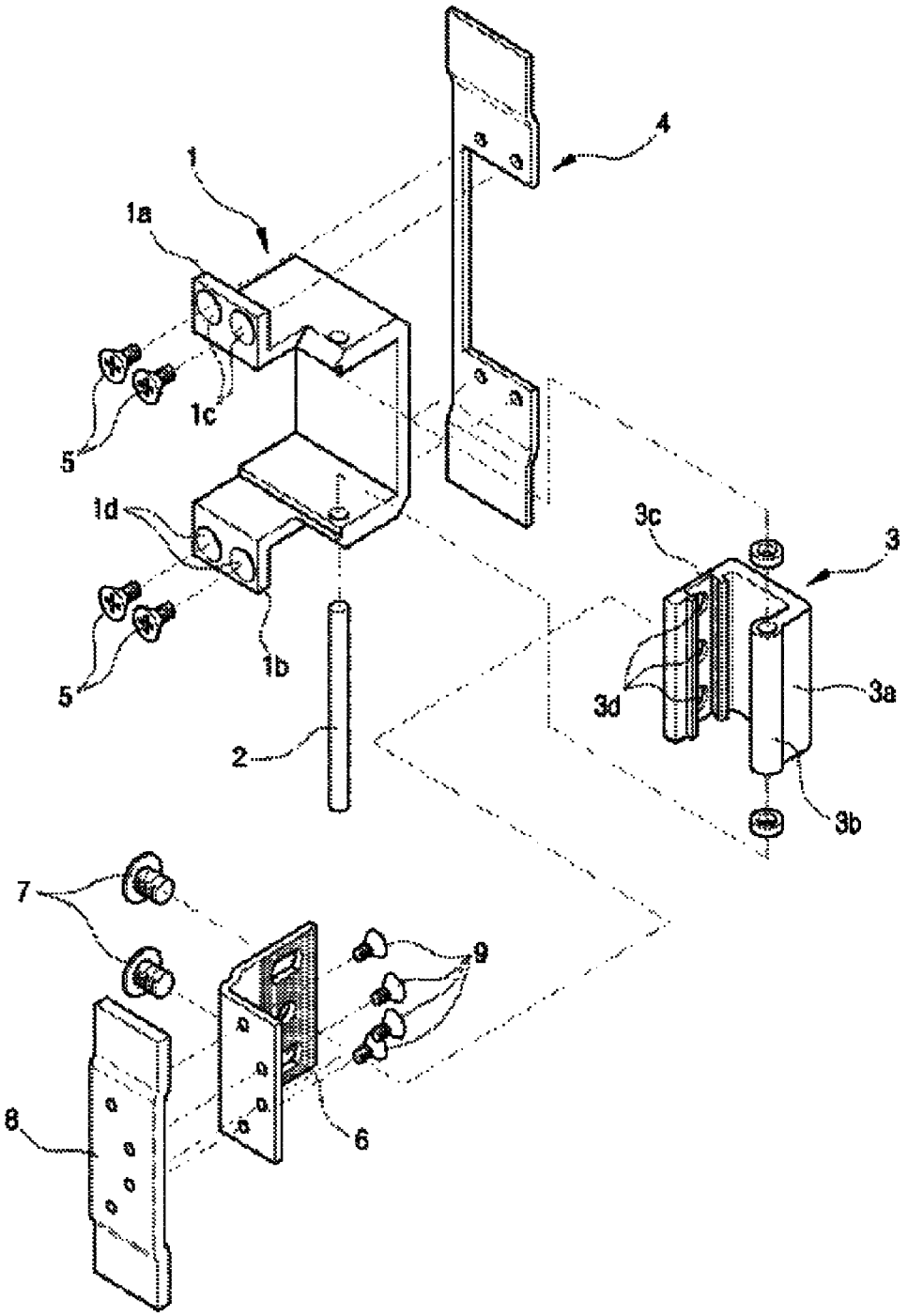
FIG. 1 Prior Art
FIG. 1 is an exploded perspective view showing a conventional hidden hinge and its accessory fasteners for installation.
Figure 2:
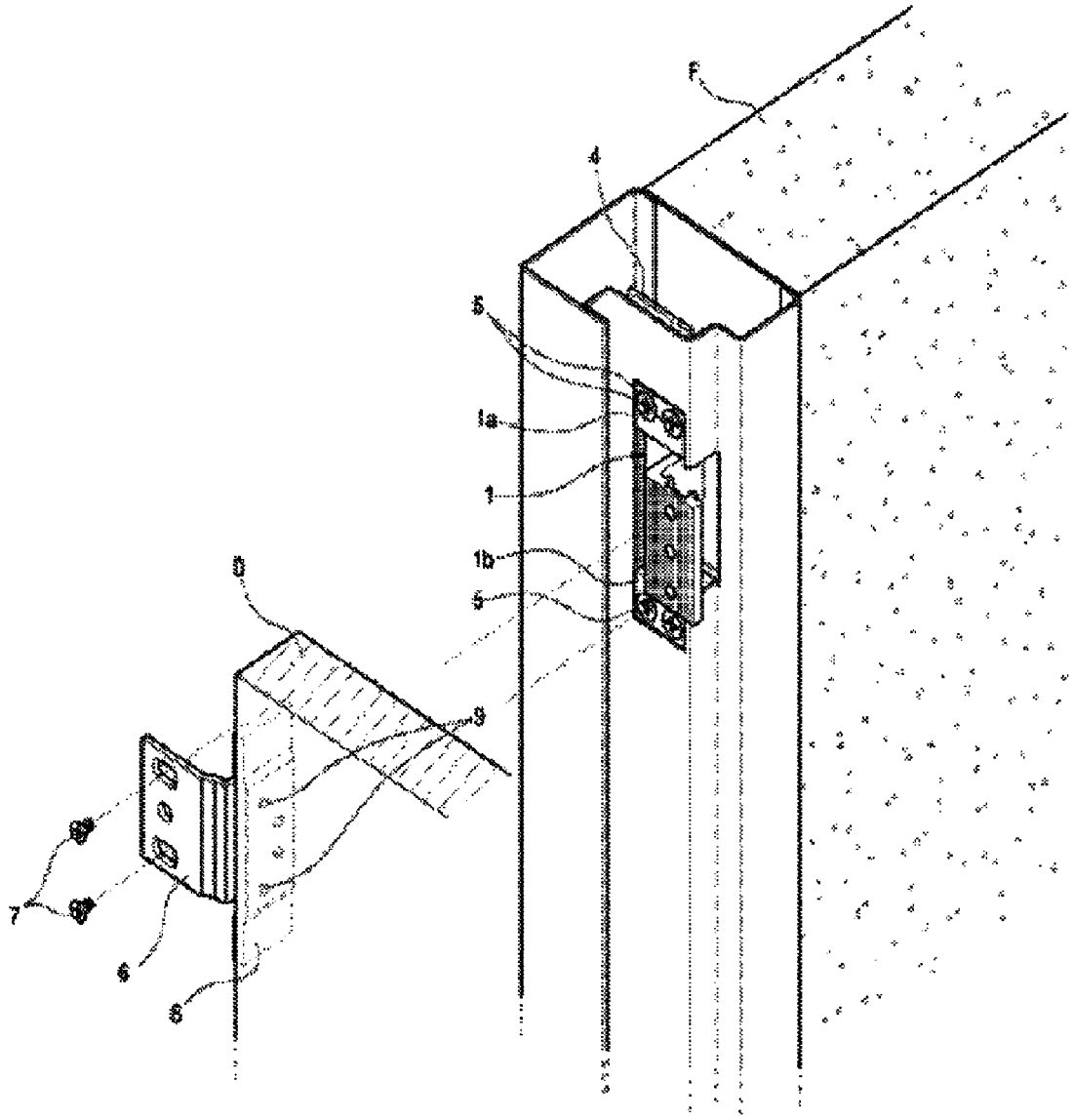
FIG. 2 Prior Art
FIG. 2 is a view showing an application of the hidden hinge shown in FIG. 1 to a fire door.

That is, as shown in FIG. 2, in construction of installing the door leaf D in the doorframe F using a conventional hidden hinge, the door leaf connecting fastener 6 has to be fastened to the rotating piece 3 of the hidden hinge installed in the hinge installation part of the doorframe F, with the door leaf connecting fastener 6 coordinated with the screw holes, under a state where the door leaf D is lifted by a required height. This requires high work precision and long working time, which may result in poor construction ability. In addition, the screws 7 have to be unscrewed one by one when the door leaf D needs to be separated from the doorframe F or needs to be adjusted for later drooping or needs to be replaced due to aging, which may result in poor workability. However, this embodiment has a structure where the projection 35 of the connecting fastener 30 connected to the door leaf is primarily inserted in and fastened to the hollow 24 of the rotating piece 20 attached to the door leaf, which may result in high workability and reduced working time.

In addition, when the door leaf D is installed in the doorframe F with the conventional hidden hinge, the vertical height of the door leaf D have to be adjusted precisely so that the door leaf D can fit into the doorframe F. However, it is very difficult to adjust the vertical height of the door leaf D with respect to the doorframe F under the state where the door leaf connecting fastener 6 to be assembled in the rotating piece 3 of the hidden hinge and the auxiliary fastener 8 are installed in the door leaf D, which may result in great difficulty in construction. In contrast, this embodiment has an advantage that the height of the door leaf can be minutely adjusted by simple bolt handling of the first adjustor 126 located in the vertical side of the rotating piece 20.

In addition, when the door leaf is fastened to the doorframe, the horizontal intervals of door leaf may be frequently out of order due to use of many hinges. However, the horizontal intervals cannot be adjusted by conventional screw combination of the connecting fastener. In contrast, in this embodiment, the horizontal adjustment, i.e., the interval between the door leaf and the doorframe, can be easily adjusted by the second adjustor 128 located in the opposite side to the opening of the hollow 24 of the rotating piece and, further, the door leaf can be completely fastened to the doorframe through a locking mechanism 125 located in the center of the outer or inner side of the second bent portion 23 of the rotating piece 20, which may result in prevention of the door leaf from being twisted in long use and high durability.

Although a few exemplary embodiments have been shown and described, it will be appreciated by those skilled in the art that adaptations and changes may be made in these exemplary embodiments without departing from the spirit and scope of the invention, the scope of which is defined in the appended claims and their equivalents.

INDUSTRIAL APPLICABILITY

According to the present invention, in various door constructions, a projection of a door leaf can be easily inserted in a hollow of a doorframe, height of the door leaf can be minutely adjusted, and an interval between the door leaf and the doorframe can be easily adjusted, which can result in easy fastening of the door leaf and the doorframe and reduced construction time.

In addition, since the door leaf can be completely fastened to the doorframe through the locking mechanism, the door leaf can be prevented from being twisted in long use, thereby increasing its durability.

The hidden hinge of the present invention has high utility for up-to-date energy-saving door and is highly applicable to various building structures and equipment with strengthened security.

The invention claimed is:

1. A hidden door hinge comprising:

a fixing piece having a 'C' shaped bent structure and being fixed to a hinge installation part of a doorframe;

a rotating piece comprising a hollow on one end and an axial pin connecting piece on another end, an axial pin connected to said connecting piece and serving as a rotating support axis, the rotating piece is inserted into the 'C' shaped bent structure and pivotally connected thereto by said axial pin of the fixing piece; and a 'L' shaped door leaf connecting fastener having a connector joined to the door leaf and a projection extending therefrom and being inserted into and adjustably connected to the hollow of the rotating piece, wherein the hollow of the rotating piece is an opening extending in a vertical direction, two first adjustors are adjustably connected to respective upper and lower ends of said hollow to engage said projection, and the vertical position of the projection relative to the hollow is adjusted by said first adjustors, such that the height of the door leaf is adjusted, wherein the rotating piece comprises a first bent portion, which is a short bent portion in which the axial pin is located, and a second bent portion, which is a long bent portion in which the hollow is formed, and wherein a through hole is formed in which the axial pin is inserted in the connecting piece, and a threaded through hole is formed in the middle of a sidewall of the second bent portion, and a bolt is threadably engaged with said threaded through hole for fastening the projection inserted in the hollow.

2. The hidden door hinge of claim 1, wherein the first adjustors comprise first screw holes formed in respective upper wall and a lower wall of said second bent section, a bolt is threadably engaged with each screw hole to engage the projection for adjusting the vertical position of the projection.

3. The hidden door hinge of claim 2, wherein the projection vertically extends from a first side of the connector, and grooves are formed in the projection to receive the bolts.

4. The hidden door hinge of claim 3, further comprising:

a second adjustor located in a rear wall of said second bent portion opposite to the opening of the hollow, the second adjustor being provided to adjust horizontal movement of the door leaf by adjusting horizontal movement of the projection.

5. The hidden door hinge of claim 4, wherein the second adjustor comprises:

a second screw hole formed in the rear wall of the second bent portion; and a second bolt connected to the second screw hole to adjust the horizontal movement of the door leaf.

6. The hidden door hinge of claim 2, wherein each of the bolts comprises a polygonal shaped groove formed at a top surface thereof and has a base.

7. The hidden door hinge of claim 2, wherein the bolts are wrench-typed polygonal bolts having a base.

8. The hidden door hinge of claim 1, wherein a top end and a bottom end of the C-shaped bent structure of the fixing piece comprise a flange, and an edge of each flange diagonally opposing the axial pin is beveled.

* * * * *